US005404687A

United States Patent [19]

Blake et al.

[11] Patent Number: 5,404,687

[45] Date of Patent: Apr. 11, 1995

[54] INTUMESCENT FIREPROOFING PANEL SYSTEM

[75] Inventors: Melvyn Blake, Framingham, Mass.; George K. Castle, Baton Rouge, La.

[73] Assignee: Avco Corporation, Providence, R.I.

[21] Appl. No.: 690,519

[22] Filed: Apr. 24, 1991

[51] Int. Cl.[6] ..... E04B 2/04; E04H 9/16; E04C 2/06

[52] U.S. Cl. ..... 52/600; 52/1; 52/232; 52/309.7; 52/309.16; 52/541

[58] Field of Search ..... 52/600, 309.2, 309.7, 52/309.16, 443, 541, 232, 1

[56] References Cited

U.S. PATENT DOCUMENTS

| | | | |
|---|---|---|---|
| 1,386,554 | 8/1921 | Dalglish | 52/600 |
| 3,570,208 | 3/1971 | Nikai et al. | 52/746 |
| 4,276,332 | 6/1981 | Castle | 428/36 |
| 4,517,782 | 5/1985 | Shamszadeh | 52/600 |
| 4,854,107 | 8/1989 | Roberts | 52/725 |
| 4,936,064 | 6/1990 | Gibb | 52/1 |

FOREIGN PATENT DOCUMENTS

| | | | |
|---|---|---|---|
| 1808187 | 6/1970 | Germany | E04C 1/46 |
| 3921802 | 1/1991 | Germany | E04B 1/62 |
| 178052 | 6/1935 | Switzerland . | |

*Primary Examiner*—Carl D. Friedman
*Assistant Examiner*—Christopher Todd Kent
*Attorney, Agent, or Firm*—Edmund J. Walsh; Mary E. Porter

[57] ABSTRACT

A system of fireproofing panels. The panels are light weight and easy to install. Lap joints are formed between the panels and simply secured with screws. No fireproofing material need be applied over the joints or the screws. In one embodiment, the panels are screwed to a corrugated underlayment. In an alternative embodiment, brackets are used to hold several panels in place around structural members. Also, the panels can be fabricated with a metal foil backing which acts as a radiation shield during a fire.

10 Claims, 3 Drawing Sheets

INTUMESCENT FIREPROOFING PANEL SYSTEM

BACKGROUND

This application relates generally to fireproofing products and more specifically to fireproofing panels.

Fireproofing is an important segment of an overall fire protection system to protect people and property. The fireproofing is applied over some type of substrate. Typically, fireproofing is applied to structural members in areas where a fire can occur. In the event of fire, fireproofing will retard the rate of temperature increase in the structural members such that the failure temperature of the members can be delayed for as much as several hours. During the period of delay, the fire may be extinguished or, at the least, the structure can be safely evacuated. When no fireproofing is used, structural members have been known to fail, thus resulting in structure collapse, in less than 15 minutes.

Fireproofing is also applied to elements such as walls, bulkheads, or decks. In a fire, the fireproofing delays an increase in temperature behind the element. Where flammable material is stored behind the element, the fireproofing can prevent ignition of the material, hopefully until the fire is extinguished.

Fireproofing is also applied to pressure vessels. The fireproofing reduces the possibility that the vessel will rupture. Thus, the fireproofing reduces the chance of explosion or release of hazardous material from the vessel.

Fireproofing is also used over cable trays. The fireproofing can keep the circuitry in the tray functioning for an extended period of time in the event of a fire.

One widely used type of fireproofing is a char-forming coating. The coating can be called ablative, subliming, or intumescent. As supplied, these coatings can be in the form of a low viscosity paint or a high viscosity mastic. These coatings are sprayed or troweled or brushed on to a substrate.

Some of these coatings are used in combination with a mesh element. Some coatings utilize a flammable mesh, others a non-flammable mesh such as one fabricated from steel. With some coatings, the mesh is mechanically mounted on the substrated; with others, it is simply embedded in the coating.

When these coatings are exposed to a fire, they undergo a number of changes of state—solid to liquid, liquid to gas, and solid to gas—absorbing some of the energy of the fire, and insulating the substrate. Fire exposure results in the formation of a char which, depending on the material, can be thicker, as thick, or less thick than the thickness of the non-fire exposed coating.

The above-mentioned mesh element may perform one or more functions. Mesh might be used to retain char on the substrate. It might be used to retain the fireproofing material on the substrate before a fire even if the fireproofing material adheres to the substrate. In other instances, the mesh reinforces the fireproofing prior to a fire to reduce damage to the coating of fireproofing which could be caused by impact or movement of the substrate.

One example of a fireproofing compound which forms a char is CHARTEK intumescent epoxy coating sold by Textron Specialty Materials of Lowell, Mass., USA. Other such materials are described in U.S. Pat. No. 3,849,178, issued to Feldman.

It has been suggested that the cost of installing fireproofing could be reduced if the substrate were covered with fireproofing panels. Panels could be installed without the special equipment needed to apply coatings of fireproofing material. Also, surface preparation needed before a coating can be applied could be eliminated if panels were used. Further, a coating can be applied to an outside structure only if weather conditions are favorable while the coating is applied and is curing. Installation of panels is much less dependent on weather conditions.

Panels made of fireproofing material similar to concrete are commercially available. For example, U.S. Pat. No. 4,567,705, to Carlson describes such panels. To protect a substrate, steel studs are welded to the substrate in a predetermined pattern. The stud positions match holes in the panels. The panels are then mounted on the studs and bolted to the substrate.

To cover a substrate larger than a single panel, many panels are mounted to the substrate. The panels are butted together. The space between the panels is caulked to provide a barrier to moisture. The panels are, however, very heavy and are difficult to install in some places. Also, such panels are not used where the fireproofing must have an A or a H rating.

Lightweight pieces made from char forming compounds have also been suggested. U.S. Pat. No. 4,493,945, shows lightweight pieces of fireproofing material used to cover a substrate. Relatively complicated fastening mechanisms are employed. Morever, it is necessary to still use char-forming compound in its liquid (mastic) form to seal the seams between pieces.

The pieces shown in U.S. Pat. No. 4,493,945, have also been formed as panels. The panels are attached to walls or large substrates by bolting them to studs mounted to the substrate. The joints between panels and the bolts are then covered by a char-forming compound in liquid form.

Such a system could be improved in several ways. First, the need to seal seams with fireproofing material requires favorable weather conditions, which is one of the disadvantages of the sprayed-on and troweled-on mastics. Also, metal studs conduct heat to the substrate. If adequate precautions are not taken, the studs might conduct enough heat to the substrate during a fire to damage the substrate. Even where no damage to the substrate occurs, the studs may conduct enough heat to make hot spots on the substrate. These hot spots prevent the fireproofing system from qualifying for an A or H fire rating. Also, the panels must be carefully installed to keep the joints between panels very small. Even with careful installation, the seams represent weak points in the fire protection which may fail in an explosion or if exposed to a burning gas jet. Such causes of stress on the joints are likely to occur during a fire. Even with no particular stress, the joints between panels may open as the fireproofing material of the panels undergoes state changes in a fire.

SUMMARY OF THE INVENTION

With the foregoing background in mind, it is an object of this invention to provide fireproofing panels which can be easily installed.

It is also an object to provide fireproofing panels which can cover a large substrate with improved seam integrity.

It is also an object to provide fireproofing panels which can be secured together with exposed fasteners.

The foregoing and other objects are achieved in a system of panels molded from char-forming coating. The panels are molded to interface at lap joints. The joint portion of each panel contains a sheet of metal mesh embedded in the char-forming material. To join panels, they are pushed together to form a lap joint and the metal mesh sheets of the two panels are held together by a screw.

In one embodiment, the panels are mounted to a substrate by first screwing a sublayer comprising a corrugated element to the substrate. The panels are then affixed to the corrugated element with exposed fasteners.

In another embodiment, the panels are cut to the width of a structural member. Several panels are joined along one surface of the structural member using lap joints. Panels on adjacent faces of the structural member are joined using an angluar piece of stainless steel screwed to the panels on adjacent surfaces.

According to another feature of the invention, a sheet of aluminum foil is pressed into the back of each panel during molding. The aluminum foil acts as a radiation shield during a fire to further protect the substrate.

BRIEF DESCRIPTION OF THE DRAWINGS

The invention will be better understood by reference to the following more detailed description and accompanying drawings in which.

DESCRIPTION OF PREFERRED EMBODIMENT

Figure 1:
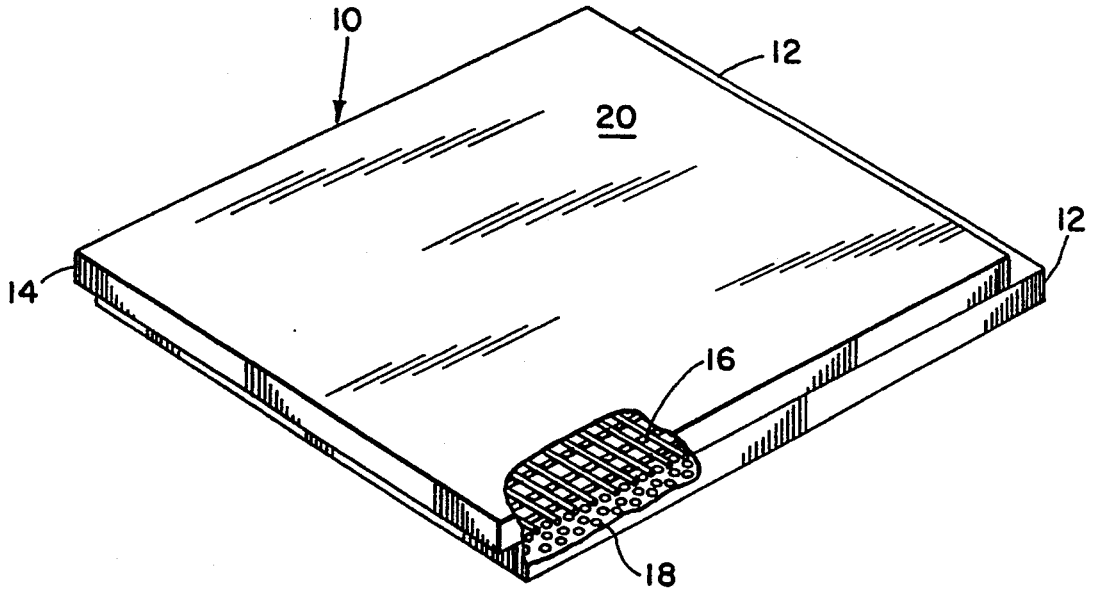
FIG. 1 is an isometric view of a fireproofing panel, partially cutaway.

FIG. 1 shows a fireproofing panel 10 fabricated according to the invention. Fireproofing panel 10 is molded from a known intumescent fireproofing coating material which will convert to a char upon exposure to a fire.

Fireproofing panel 10 has a ledge 12 along two edges. There is an overhang 14 along the other two edges. When two fireproofing panels are placed side by side with the same orientation, ledge 12 of one panel and overhang 14 of the other panel interlock to form a lap joint.

Embedded in fireproofing panel 10 is a wire mesh 16. Here wire mesh 16 is an open mesh with a one half inch by one half inch (12.7 mm by 12.7 mm) opening formed from 19 swg wire. Wire mesh 16 reinforces the cured fireproofing material before a fire. During a fire, mesh 16 reinforces the char once it forms. Of course, other sizes and types of mesh could be used for these purposes.

Also embedded in fireproofing panel 10 is a second piece of mesh. Here, that mesh is perforated metal 18. Unlike wire mesh 16, perforated metal 18 is disposed in only a portion of fire protecting panel 16. Namely, perforated metal 18 is disposed only in ledge 12.

When fireproofing panel 10 is mounted to protect some substrate (not shown) from fire, front surface 20 faces away from the substrate. When multiple fireproofing panels are mounted to form lap joints, perforated metal 18 of one of the panels will always be at the rear of the lap joint. A screw (screw 58, FIG. 3A) through the lap joint applied from front surface 20 will pierce wire mesh 16 of one panel and firmly engage perforated metal 18 of the other panel. Thus, the two panels will be held tightly together at the lap joint by the screw (screw 58 FIG. 3A).

For the lap joint to be held together, perforated metal 18 must be strong enough to anchor screw 58. Here, 22 guage perforated metal with 3/32" (2.4 mm) round holes on 5/32" (4.0 mm) centers is used. Other perforated metals could be used, but perforated metal no less dense than metal with 3/16" (4.8 mm) holes on ¼" (6.4 mm) centers is preferred. If more dense perforated metal is used, there must be enough holes in the perforated metal to allow the fireproofing material to flow through the perforated metal during molding and ensure that perforated metal 18 is strongly bonded to the panel.

Figure 2:
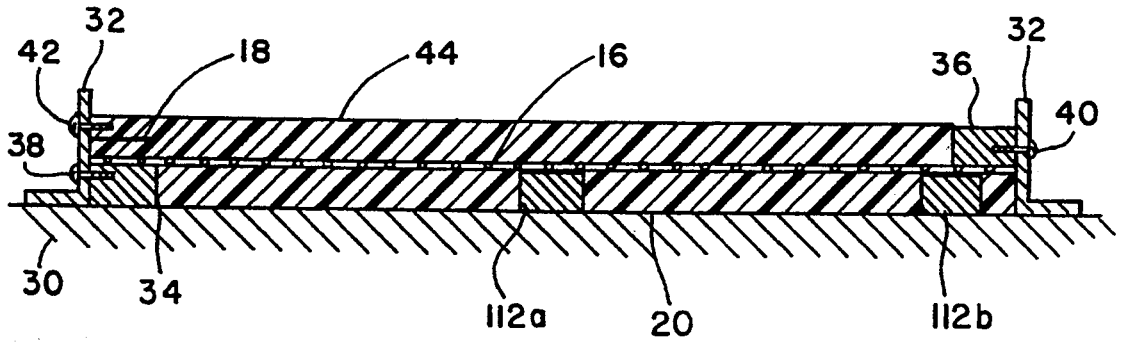
FIG. 2 is a cross sectional view of a mold used to form the panel of FIG. 1.

Turning now to FIG. 2, a mold for forming fireproofing panel 10 is shown. The mold is formed on a table or other suitable base 30. Angle brackets 32 are mounted to table 30. Screws, clamps or any convenient mounting means could be used. Angle brackets 32 define the boundaries of fireproofing panel 10. Fireproofing panels are made to any convenient size. Here, the panels are squares roughly three feet (0.9 m) on a side. Thus, angle brackets 32 are mounted to table 30 to form a three foot square.

During fabrication, shoulder 34 is placed into the mold along each edge which will have a ledge 12 (FIG. 1). Shoulder 34 is made from metal, plastic, or wood and secured in place by pin 38, or by some other convenient method such as screws. The pieces of the mold are coated with a commercially available mold release product.

Next, spacer blocks 112*a* and 112*b* are placed in the mold. Spacer blocks 112*a* and 112*b* hold mesh 16 away form surface 20. The thickness of spacers 112*a* and 112*b* is not critical. They should be approximately half the thickness of the finished panel.

As spacer blocks 112*a* and 112*b* become part of the finished panel, they are made from fireproofing material. The fireproofing material can be molded into the desired sizes of spacer blocks 112*a* and 112*b*. Alternatively, it can be molded in a sheet and cut to the right size after curing. A suitable material is also described in U.S. Pat. No. 4,529,467, but many commercially available fireproofing products are acceptable.

Next, a fireproofing material is poured into the mold until the fireproofing material comes roughly to the top of shoulder 34. The material is any known fireproofing material which is conventionally applied in a liquid state and then cures to an epoxy.

Next, wire mesh 16 is laid into the mold. Also, shoulder 36 is placed into the mold and held in place by pin 40. Shoulder 36 holds one edge of wire mesh 16 in place.

A shoulder 36 is placed along each edge which does not already contain a shoulder 34. The portion of panel 10 under shoulder 36 forms overhang 14.

Next, more fireproofing material 44 is added to the mold to cover wire mesh 16. Perforated metal 18 is placed into the mold over shoulder 34. Pin 42 is inserted to ensure perforated metal 18 remains embedded in the fireproofing material 44. The mold is then filled with fireproofing material to the top of shoulder 36.

The fireproofing material 44 is then smoothed by trowelling or by vibrating table 30. The fireproofing material 44 does not need to be completely smooth since the surface at the top of the mold will be mounted facing a substrate and will not be visible. In contrast, upper surface 20 (FIG. 1) is the surface against table 30. That surface will be smooth.

The fireproofing material is then allowed to cure. The material might be allowed to air dry or the curing could be accelerated by placing the entire mold in an oven. When cured, the panel can be removed from the mold.

Figure 3A:
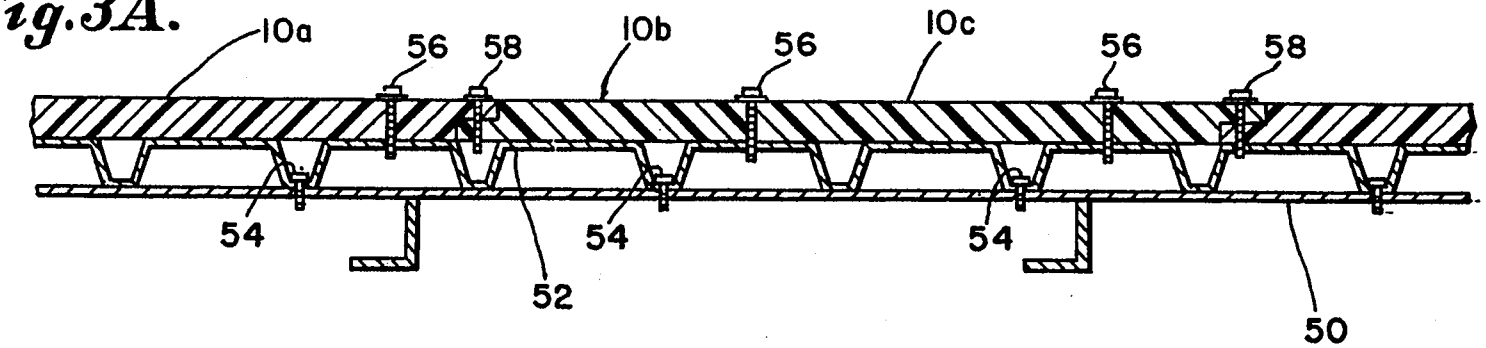
FIG. 3A is a cross sectional view showing a mounting arrangement for panels as shown in FIG. 1.

Turning now to FIG. 3A, a method of mounting several panels to protect a large substrate is shown. FIG. 3A shows a portion of a substrate 50 protected by fire protecting panels 10*a*, 10*b*, 10*c*.

To mount fire protecting panels 10*a* . . . 10*c*, a layer of corrugated material is screwed to substrate 50. Here, 0.7 mm galvanized steel roof decking with profile D38A is used.

Roof decking 52 is secured to substrate 50 via screws 54. Here, TRAXX 4–12/24×22 mm screws are used. It is important to note that no special insulation or heat treatment is needed to prevent screws 54 from transmitting excessive heat to substrate 50. Screws 54 are behind panels 10*a* . . . 10*c* and are thus thermally protected.

Next panels 10*a* . . . 10*c* are screwed into place with screws 56. Screws 56 must be long enough to pass through a fireproofing panel 10 and roof decking 52. However, screws 56 must not be so long that they contact substrate 50. Here, No. 12×25 mm stainless steel sheet metal screws are used.

Screws 56 are used with stainless steel washers (not numbered) such as 4 mm×25 mm washers. Any size washer preferably larger than the openings in mesh 16 can be used.

A sufficient number of screws must be used to secure panels 10*a* . . . 10*c*. Here, 9 screws per panel are used, or roughly one screw per square foot.

After the panels are secured, the lap joints between panels are firmly joined. Here, screws 58 with washers (not numbered) are used. Screws 58 are identical to screws 56. It should be noted from FIG. 3A that it is not crucial whether screws 58 pierce roof decking 52. Screws 58 must simply engage perforated metal 18 within ledge 12 (FIG. 1). Perforated metal 18 (FIG. 1) provides adequate support for the lap joints between panels. Screws 56, however, must be installed into a ridge of roof deck 52.

During installation, the lap joints may be caulked to prevent moisture from seeping behind panels 10*a* . . . 10*c*. This step is only important when panels 10*a*, 10*b*, 10*c* are exposed to moist environmental conditions. However, any type of caulking, such as silicone caulking, can be used. Special fireproofing caulking is not required.

From the foregoing, it will be appreciated that the fireproofing system of FIG. 3A is easily installed. Corregated roof decking 52 can be quickly installed with self tapping screws. Exact positioning is not required. Special tools are not required. Panels 10*a*, 10*b*, 10*c*, etc. are easily installed to the roof decking. The ridges of roof decking 52 preferably run vertically up a wall or other substrate. Thus, screws 56 are installed in vertical lines up the wall. Because of the width of each ridge in roof decking 52, exact placement of screws 56 is not required. Positioning of the panels is simply accomplished by pushing the panels snugly together to form the lap joints. No posts and holes are required.

Also, screws 56 can be left exposed. As shown in FIG. 3A, a thermally conducting path from screw 56 to substrate 50 includes not only screw 56 but roof decking 52. Thus, even if screw 56 gets very hot in a fire, little heat is conducted to substrate 50. Thus, the panel system shown in FIG. 3A can qualify for an A or H fire rating.

Figure 3B:
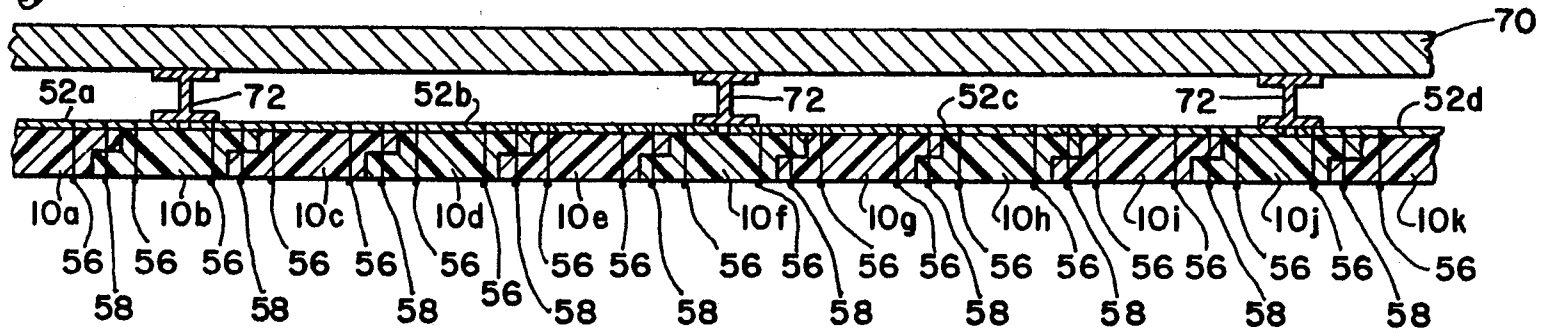
FIG. 3B is a cross sectional view showing an alternative mounting arrangement for panels as shown in FIG. 1.

Turning to FIG. 3B, the invention in another mounting arrangement is shown. In FIG. 3B, substrate 70 is a deck or a ceiling with supports 72. In steel structures supports 72 are beams spaced by a large distance, say eight feet. To install panels, sheets of roof decking 52*a* . . . 52*d* are screwed into supports 72. Then, panels 10*a* . . . 10*j* are screwed into the roof decking as in FIG. 3A and the lap joints are screwed together.

It will be appreciated that installing panels in this fashion is relatively easy since the panels are of a size which can be easily manipulated. However, joints and screw holes do not have to be filled with fire protecting material, which would be very cumbersome to apply to a ceiling or the underside of a deck. Also, the area of the surface covered by fireproofing is reduced over what would be required if fireproofing were sprayed onto deck 70 and supports 72.

Figure 4:
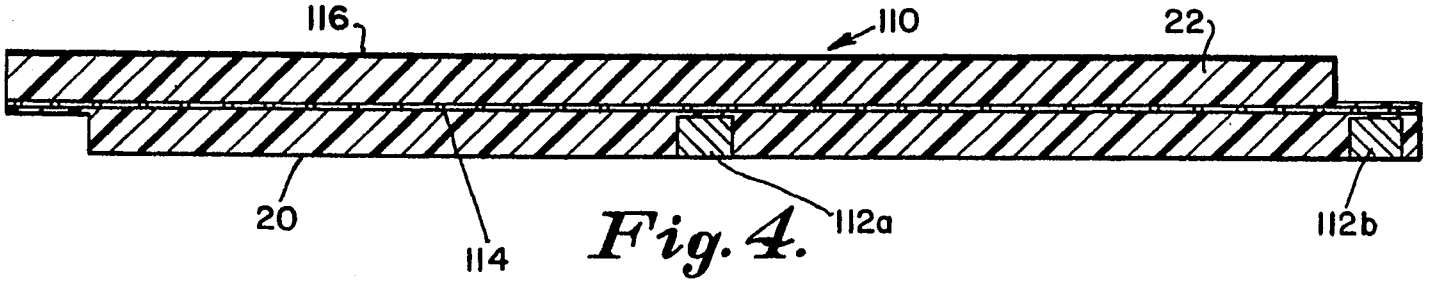
FIG. 4 is a cross sectional view of a panel constructed according to an alternative embodiment of the invention.

Turning now to FIG. 4, an alternative embodiment of the invention is shown. The embodiment of FIG. 4 is useful to cover structural members. FIG. 4 shows in cross section a fireproofing panel 110. As described above, panel 110 is molded from a commercially available fireproofing material. Here, no wire mesh is employed. Rather, perforated metal sheet 114 extends throughout the entire panel. Perforated metal sheet 114 is as described above.

During molding, perforated metal sheet 114 is held away from upper surface 20 by spacers such as spacer blocks 112*a* and 112*b*. Here, spacer blocks 112*a* and 112*b* are made of the same fire protecting material used to form panel 110.

It should be noticed that blocks 112*a* and 112*b* are of different thickness. The thicknesses of the spacer blocks 112*a* and 112*b* are selected to keep perforated metal sheet 114 as far from front surface 20 as practical but to still have it embedded in the fireproofing material forming panel 110. Spacer blocks 112*a* and 112*b* are placed in the mold before fireproofing material is poured into the mold.

FIG. 4 also shows a feature which can be added to the fireproofing panels made according to the invention. FIG. 4 shows a sheet of aluminum foil 116 on back surface 22 of panel 110. Here, aluminum foil 116 is approximately 0.00475 inches (0.12 mm) thick. It is attached to panel 110 while it is still in the mold and before the fireproofing material of the panel cures. During molding, aluminum foil 116 can simply be placed over the mold and rolled into the surface of the fireproofing material before it cures.

In a fire, some hot gases and heat may penetrate panel 110. However, aluminum foil 116 does not readily emit heat toward the substrate protected by panel 110. Also, aluminum foil 116 reduces the amount of gas which penetrate panel 110. Thus, foil 116 can reduce the amount the substrate heats up in a fire.

Figure 5:
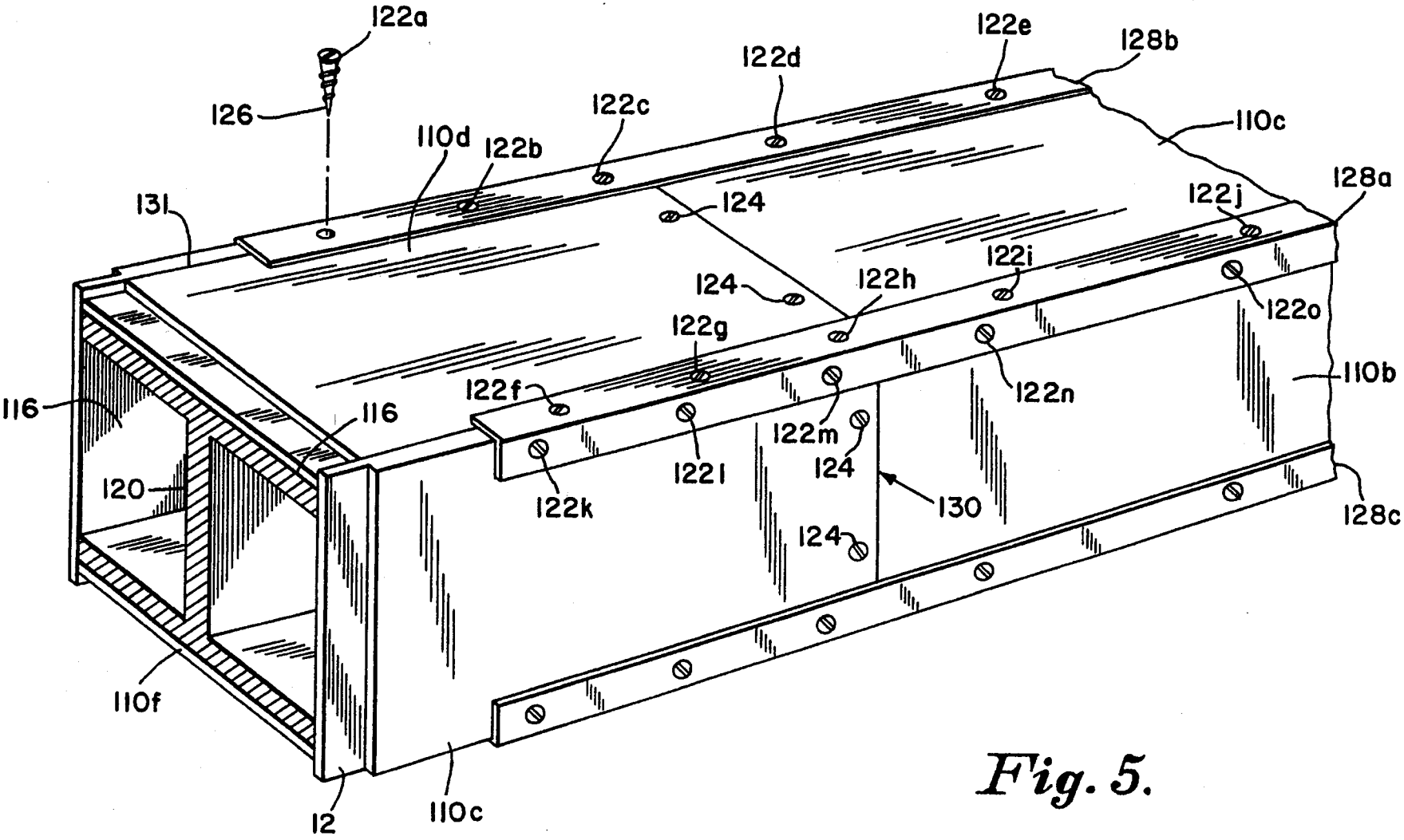
FIG. 5 is an isometric view of a mounting arrangement for the panels of FIG. 4.

FIG. 5 shows how panels 110 might be used to protect a structural member 120 from fire. Panels 110*a* . . .

110*f* are shown to have the same width as structural member 120. This width can be achieved by molding panels to any convenient width and then cutting them, using a saw, to the appropriate width. Of course no lap joints are needed on the edges of panels which span the width of structural member 120. Thus, no ledges or overhangs are formed on those edges during molding.

To span the length of a beam, several panels 110 are joined with lap joints. As before, those lap joints are secured with screws 124.

To secure panels 110 on adjacent sides of structural member 120, angle braces 128*a*–128*c* are used. Here, 20 gage 1½"×1" (38 mm×25 mm) stainless steel angle is used. Angle braces 128*a*–128*c* are secured to panels 110*a*–110*f* using screws 122*a*–122*o* (only selected screws shown). A minimum spacing of 8" between screws is preferred. Here, ¾" (19 mm) stainless steel sheet metal screws are used. The length of these screws is selected to be roughly the thickness of panels 110*a*–110*f*.

It will be appreciated that screws 122*a*–122*o* may contact structural member 120. However, little heat will be conducted to structural member 120. Screws 122*a*–122*o* end in a point 126, as is common for sheet metal screws. Thus, the total area of screws in contact with structural member 120 is small and heat transferred to structural member 120 is correspondingly small. Thus, screws 122*a*–122*o* do not need to be coated with fire protecting material.

By applying panels as shown in FIG. 5, all joints between panels are either covered by angle brace 128 or form a lap joint. The lap joints 130 and butt joints 131 may be caulked to provide a seal against weather conditions. Otherwise, no special sealing of joints is required.

As shown in FIG. 5, panels 110*a*, 110*b*, and 110*c* are mounted with open spaces in structural member 120 behind them. However, this mounting arrangement is acceptable. Perforated metal 114 (FIG. 4) provides adequate structural support. Aluminum foil 116 prevents hot gasses from penetrating into the open space during a fire.

In a fire, aluminum foil 116 may separate from the back of the panels. Foil 116 will, however, remain in place. For panels such as 110*c* and 110*d* which contact structural member 120, foil 116 is held in place because it is pressed against support member 120. For panels such as 110*a* and 110*c*, foil 116 may separate from the panels and billow into open space in support member 120. However, foil 116 will be anchored at its ends by contact with panels 110*d* and 110*f* and support member 120.

Having described embodiments of the invention, one of skill in the art will recognize that variations can be made without departing from the invention. For example, perforated metal 18 could be extended throughout the entire area of panel 10. In this way, a panel could be cut to any size and still have perforated metal along its edges to allow screw attachment. Extending perforated metal 18 throughout the entire panel adds mechanical support to the panel. This added support can be important to allow the panels to work in situations where flame jets are expected, such as represented by the SOFIPP test conventionally used to rate fire protecting systems. Angle braces to join panels such as shown in FIG. 1 could be used. Also, aluminum foil could be used to back panels as shown in FIG. 1. Further, panels could be molded in many shapes. The panels could even be molded to conform with curved surfaces.

Also, foil 116 need not be attached to a panel. Foil may be attached directly to a structural member. Panels would then be installed over the foil. Alternatively, fire protecting material could be sprayed on over the foil.

Also, panel fabrication using conveniently available fireproofing compounds was described. These materials contain fiberous material and epoxy. Varying the amount of fibers and epoxy may result in materials which are better suited to a particular molding operation. For example, the amount of fibers might be reduced on the order of 25% from the quantities described in U.S. Pat. No. 4,529,467.

Additionally, FIG. 3B shows panels applied to span spaces between structural members supporting a deck. The panels could be applied in a like fashion to cover a wall or other element with structural members attached to it.

Also, molding was described as comprising pouring fireproofing material into a mold. It might be sprayed into the mold or applied in other ways to facilitate rapid molding of panels.

Accordingly, the invention should be limited only by the spirit and scope of the appended claims.

What is claimed is:

1. A fireproofing panel adapted to be joined, along a predetermined edge of said panel, to a like predetermined edge of another fireproofing panel, comprising:

a) an intumescent fireproofing material;

b) a mesh embedded in the fireproofing material; and c) a sheet of perforated metal embedded in the fireproofing material only along the predetermined edge of each fireproofing panel.

2. The fireproofing panel of claim 1 wherein the mesh comprises an open wire mesh.

3. The fireproofing panel of claim 2 wherein the mesh extends throughout the entire fireproofing panel.

4. The fireproofing panel of claim 1 wherein the panel comprises a ledge along the predetermined edge and the mesh is embedded in the ledge.

5. The fireproofing panel of claim 4 having a maximum thickness and additionally compromising an overhang along a second predetermined edge, said overhang having a thickness equal to the difference between the maximum thickness of the fireproofing panel and the thickness of the ledge.

6. A fireproofing system, comprising the fireproofing panel of claim 5 joined with at least one additional fireproofing panel of claim 5 such that the ledge of a first panel overlaps the overhang of a second panel and a screw passes through the ledge and the overhang.

7. A fireproofing system covering a substrate comprising:

a) plurality of fireproofing panels, each comprising an intumescent fireproofing material and a sheet of perforated metal embedded in the fireproofing material and each panel having a side facing the substrate and a side facing away from the substrate;

b) a plurality of means for mounting each panel of the plurality of fireproofing panels on the substrate, said fastening means having an exposed portion on the side of the panel away from the substrate, wherein the means for fastening comprises at least one screw having a pointed end, said screw passing through the perforated metal of at least one panel and contacting the substrate only at the pointed end of said screw.

8. The fireproofing system of claim 7 wherein the panels have a thickness of less than 12 mm.

9. A fireproofing panel with first and second edges comprising:

a) an intumescent fireproofing material having a maximum thickness at a point away from the first and second edges with a decreased thickness at the first edge and a thickness at the second edge equal to the difference between the maximum thickness and the thickness at the first edge; and b) at least one sheet of perforated metal embedded in the fireproofing material and extending throughout the entire fireproofing panel.

10. The fireproofing panel of claim 9 wherein the perforated metal has holes at least 3/16" in diameter with centers spaced apart no more than ¼".

* * * * *